US005615791A

United States Patent [19]

Vatelot et al.

[11] Patent Number: 5,615,791

[45] Date of Patent: Apr. 1, 1997

[54] SYSTEM OF A BOTTLE AND OF AN ASSOCIATED CO-OPERATING DEVICE

[76] Inventors: Yves Vatelot, 31 Place de la Madeleine, Paris, France, 75008; Jacques Demeester, Via Delle Scuole 1, Lugano, Switzerland, 6900

[21] Appl. No.: 485,696

[22] Filed: Jun. 7, 1995

[30] Foreign Application Priority Data

| | | | |
|---|---|---|---|
| Aug. 10, 1994 | [FR] | France | 94 09910 |
| Jan. 11, 1995 | [FR] | France | 95 00271 |

[51] Int. Cl.[6] ..... B65D 21/08

[52] U.S. Cl. ..... 215/382; 220/666; 222/92

[58] Field of Search ..... 215/382, 383; 220/666, 667; 222/92, 107

[56] References Cited

U.S. PATENT DOCUMENTS

| | | | |
|---|---|---|---|
| 3,160,323 | 12/1964 | Weisberg | 222/107 |
| 3,260,412 | 7/1966 | Larkin | 222/107 |
| 3,301,293 | 1/1967 | Santelli | 220/666 |
| 3,474,844 | 10/1969 | Lindstrom et al. | 220/666 |
| 3,557,788 | 1/1971 | Swartz | 220/666 X |
| 3,966,085 | 6/1976 | Norton | 220/327 |
| 4,456,134 | 6/1984 | Cooper . | |
| 5,002,193 | 3/1991 | Touzani | 215/382 X |
| 5,158,123 | 10/1992 | Senko | 220/666 X |
| 5,240,130 | 8/1993 | Osbakk | 220/666 X |
| 5,310,068 | 5/1994 | Saghri . | |

FOREIGN PATENT DOCUMENTS

| | | | |
|---|---|---|---|
| 406134 | 1/1991 | European Pat. Off. | 220/666 |
| 10936 | 9/1909 | France . | |
| 912198 | 4/1946 | France . | |
| 2076210 | 9/1971 | France . | |
| 2695627 | 3/1994 | France . | |
| 8900480 | 5/1989 | Germany . | |
| 4009686 | 10/1991 | Germany . | |
| 9316296 | 4/1994 | Germany . | |
| 677533 | 8/1952 | United Kingdom . | |

*Primary Examiner*—Allan N. Shoap
*Assistant Examiner*—Christopher J. McDonald

[57] ABSTRACT

A system comprising a bottle with a variable volume the outer side wall of which is deformable in the direction of the height and a device integrated into the inside of the bottle and retained in the latter to hold the bottle in one of a series of states of volume and to allow its gradual deformation from one state of given volume to another state of smaller volume, the system being applicable in particular to fizzy beverages.

23 Claims, 6 Drawing Sheets

Fig. 2D
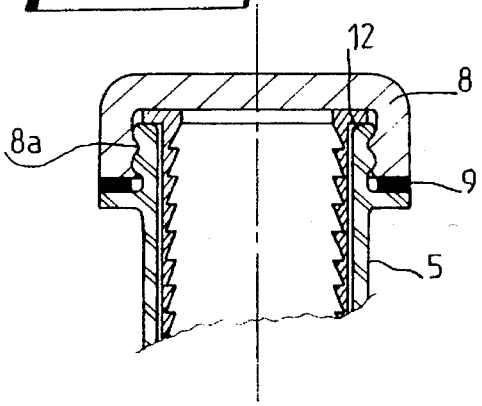
Fig. 3
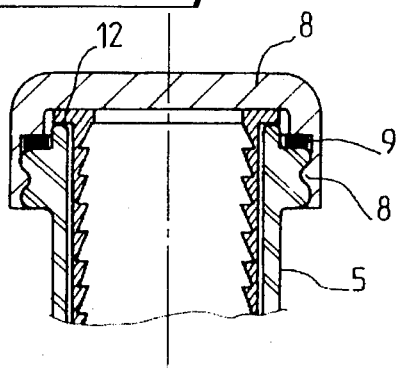
Fig. 1
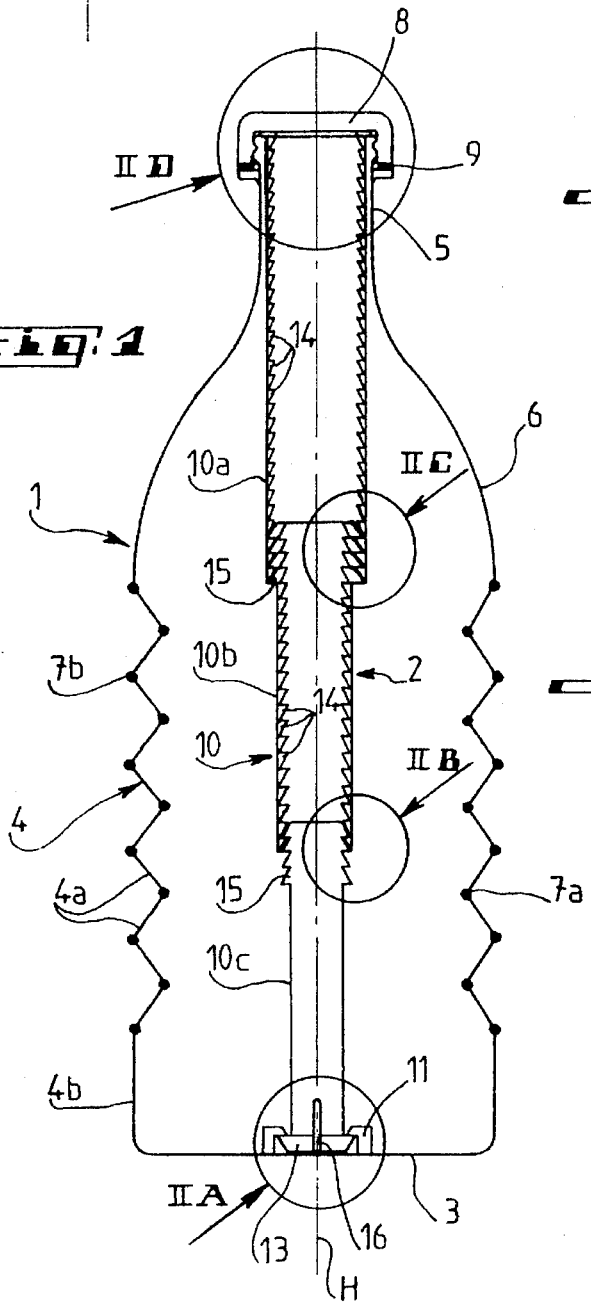
Fig. 2C
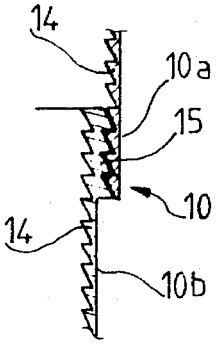
Fig. 2B
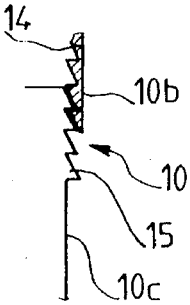
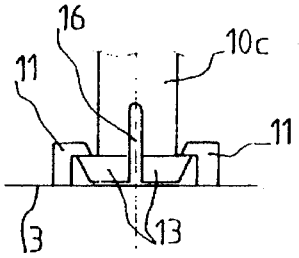
Fig. 2A

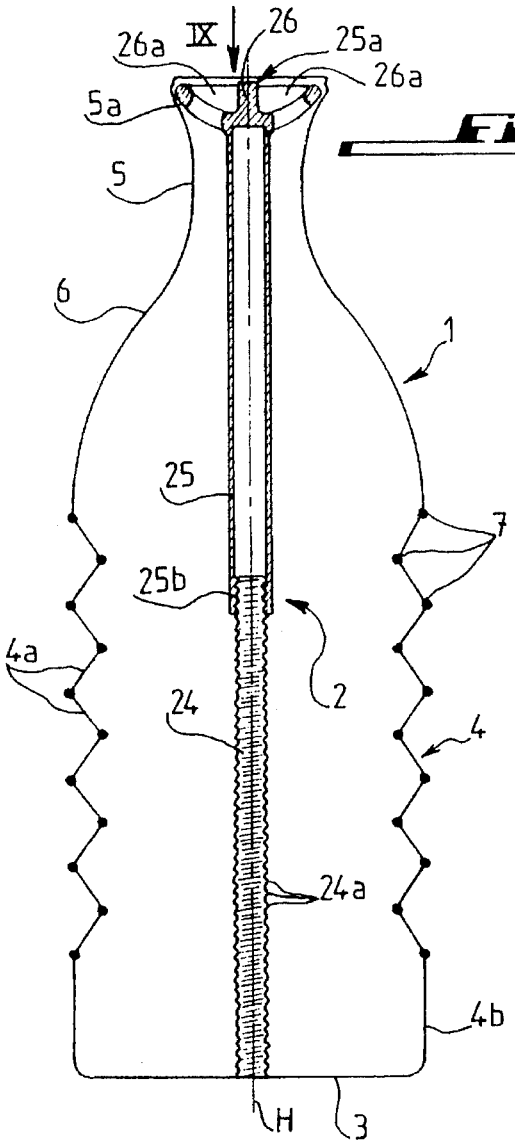
Fig. 8
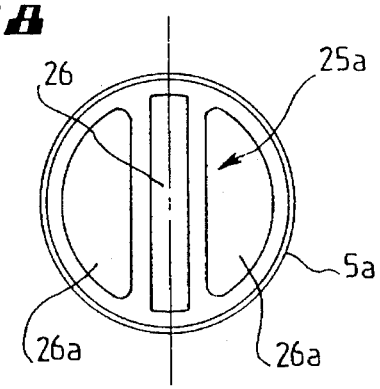
Fig. 9
Fig. 10
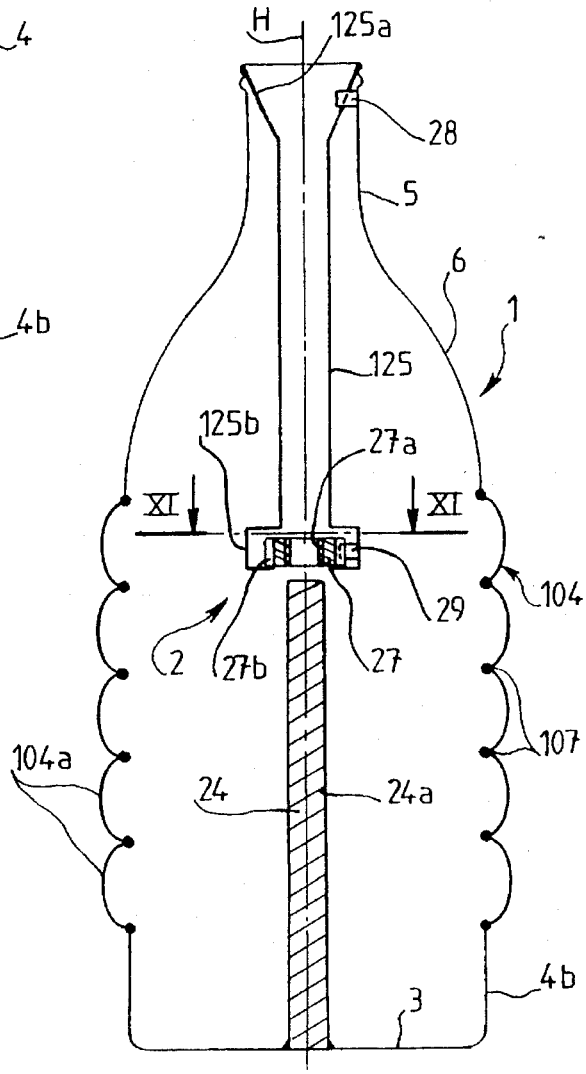
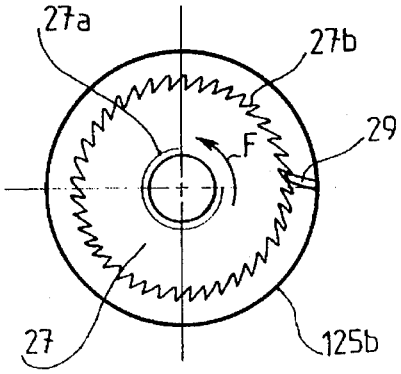
Fig. 11

FIG. 17
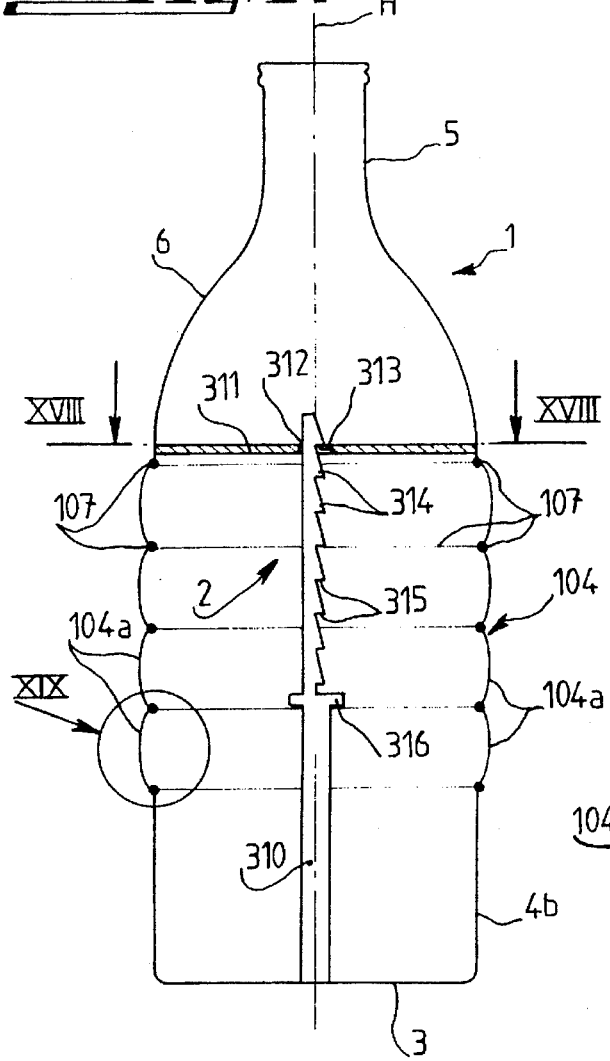
FIG. 20
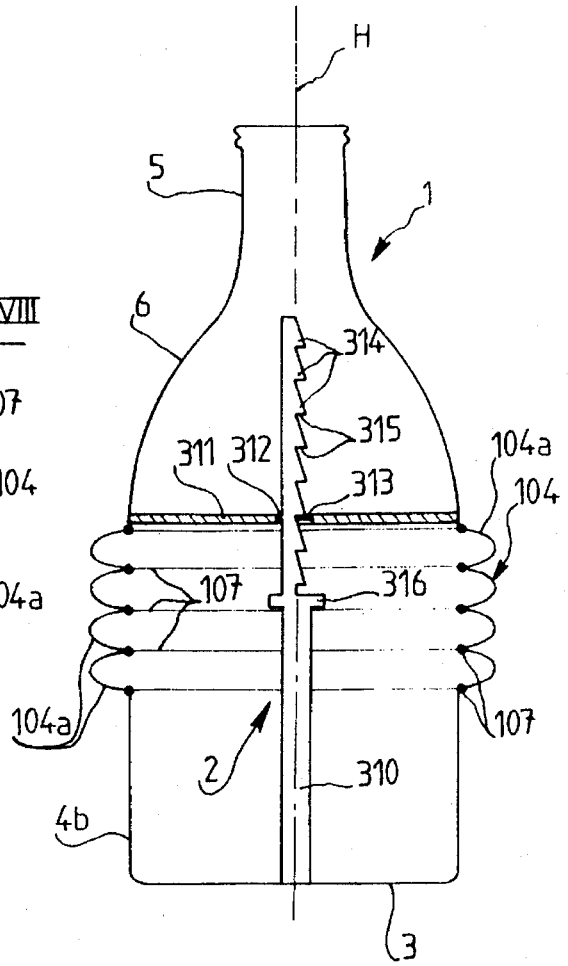
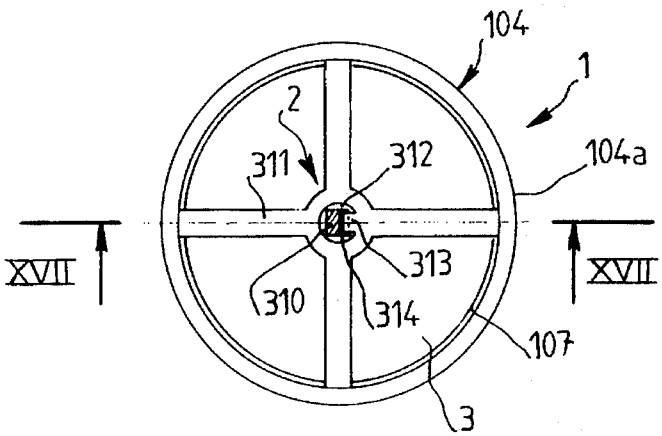
FIG. 18
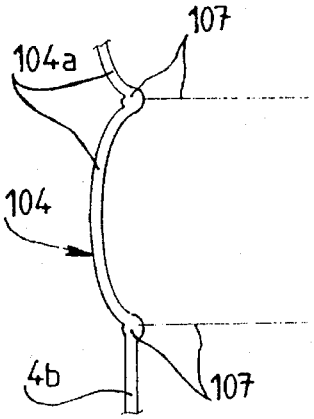
FIG. 19

Fig. 21
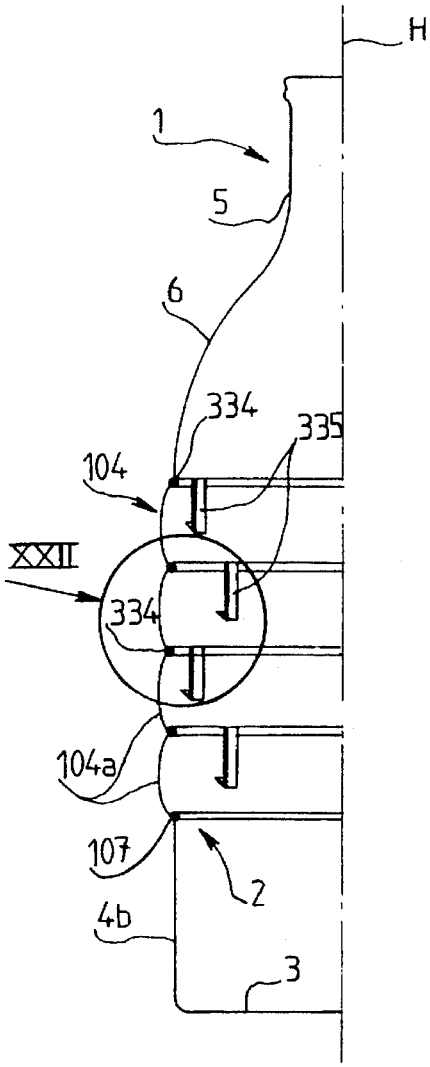
Fig. 24
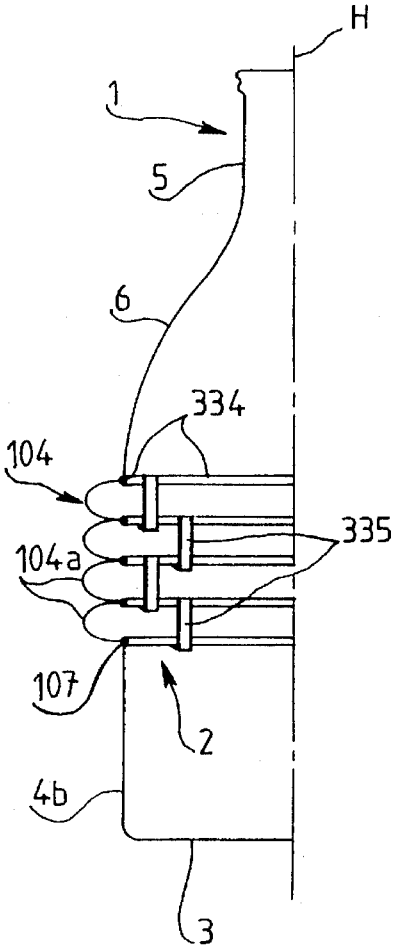
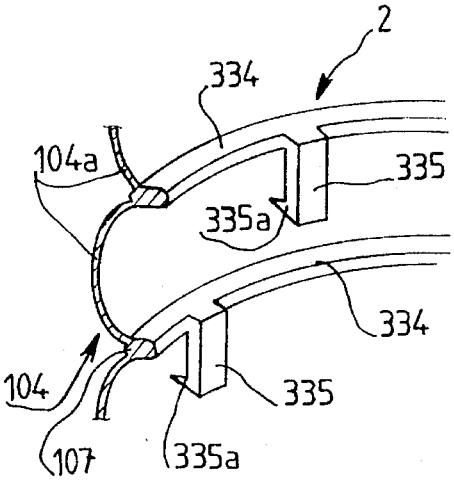
Fig. 22
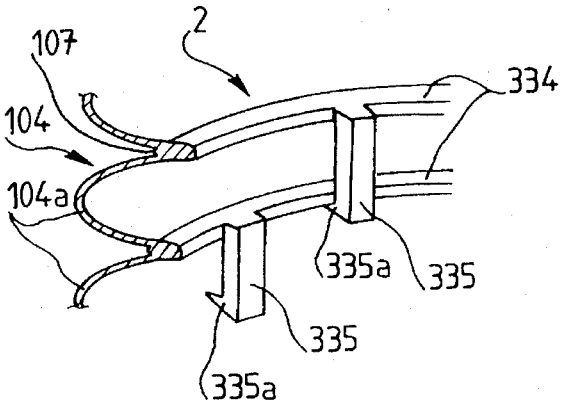
Fig. 23

SYSTEM OF A BOTTLE AND OF AN ASSOCIATED CO-OPERATING DEVICE

BACKGROUND

The present invention relates to a system of a bottle made for instance from plastics material with a variable volume intended to contain a liquid, in particular a fizzy beverage or gasified or sparkling drink (referred to hereinafter as a fizzy drink) and of an associated co-operating device.

One often uses for containing an alimentary liquid a substantially cylindrical or polygonal bottle made from plastics material and having at its upper part a neck through which the liquid may be inserted into the bottle or poured outwards thereof.

In the case of sparkling or fizzy beverages, the bottles with a fixed volume do not permit to preserve their gas content in a satisfactory manner during the consumption thereof.

Indeed prior to the first use of the bottle, i.e. before its first being opened, the gas volume topping the contained liquid is reduced to a minimum in the zone inside of the neck and a pressure balance builds up between the gas dissolved in the liquid and the gas topping the latter. The initial gas content of the liquid is determined by this pressure equilibrium and may be predetermined in the case of a gasifying of the liquid.

At each successive use of the bottle, one portion of the contained liquid is poured to the outside and air enters the bottle to replace by an equal volume the liquid poured to the outside.

After every use, a new pressure balance is set up between the gas volume topping the liquid and the gas bubbles dissolved in the latter. The gas bubbles are migrating towards the surface of the liquid to balance the pressure inside of the bottle.

Therefore on each use, the air which enters the bottle decreases the partial pressure of the gas topping the liquid and thus causes a degasification of the latter.

This physical phenomenon is all the more important as the utilizations are spaced in time which generally occurs when the so-called "family" bottles are used, namely bottles with a volumetric capacity of 1.5 to 2 liters for instance.

This degasification constitutes a major inconvenience in the consumption of fizzy drinks since the decrease of the gas content of these beverages results in an impairment of their taste.

There is already known from the document U.S. Pat. No. 4,456,134 in the name of Cooper a vessel having a top opening for the filling and the pouring of fizzy drinks, which opening is extended towards the bottom of the vessel by a flexible and compressible or deformable middle wall. This document also proposes a device externally connecting the part above the bottom of the vessel to progressively adjust and maintain the internal volume thereof.

This external device at least partially and concentrically encloses the vessel or is eccentered with respect thereto so as to be easily adaptable to the different types of existing vessels and to be reusable fully or in part on another vessel after complete consumption of the liquid contained in the original vessel.

The solution proposed by Cooper has the inconvenience to require the user to always take with him the external device permitting to keep the bottle in a state of reduced volume, thereby significantly increasing the bulk of the bottle for example in the bag of the user without taking into account the fact that the user may easily forget to take this device with him.

Moreover after the initial filling of the bottles during the conditioning, the latter are stored for a more or less long period in warehouses or distribution centers where the consumer will later come to buy the desired drink.

For this storage period the bottles, Which always have some elasticity, are generally ending in becoming deformed or elongated under the effect of the strong internal pressure exerted by the gas dissolved in the liquid thereby resulting in the formation of an air space topping the liquid in the bottle, in which space the gas may escape and thus result in a previous degasification of the beverage before an external device may be used.

It is also possible during the conditioning of the bottle to take this elongation of the bottle during its storage into account by filling it with an amount of drink sufficient to occupy the initial volume or volume at rest of the bottle increased by the estimated elongation.

In this case however there will occur an outflow of the liquid out of the bottle upon its first being opened by the user through elastic relaxation of the bottle towards its state of initial volume, which is unacceptable.

There is also known another system aiming at coping with the degasification of the beverages during their consumption, which proposes to fit the bottle after its first being opened and after each subsequent use with a special closing stopper with a check valve and to provide a gas overpressure in the air volume topping the liquid to restore the initial pressure balance and to stop the escape of gaseous carbon dioxide within the bottle.

This known system however has the inconvenience of a high cost, a constraining utilization and above all this system surprisingly restricts but imperfectly the escape of the gas dissolved in the liquid.

Furthermore the increase of the air volume contained in the bottle during its use as well as a possible introduction of air under pressure may also be a drawback from the sanitary standpoint owing to the possible pollution of the liquid by the air entering the bottle.

The object of the present invention is therefore to remove the aforesaid inconveniences and to provide a system of a bottle with a variable volume and of an associated co-operating device permitting to fully avoid that the contained liquid goes flat or becomes staled since its initial conditioning until its total consumption and the manufacture of which should be inexpensive and its use should be simple.

SUMMARY OF THE INVENTION

For that purpose the subject matter of the present invention is a system of a bottle with a variable volume intended to contain in particular a liquid with a gas content, of the type comprising a deformable external side wall and of an associated co-operating device to hold the bottle in one of a series of states of internal volume and to permit its gradual deformation from one state of given volume to another state of in particular smaller volume so as to conform the inner volume of the bottle to the volume of liquid remaining in the latter, characterized in that the aforesaid device is integrated into the inside of the bottle and retained in the latter.

According to another characterizing feature of the invention the deformation is made in the longitudinal direction of the bottle and the device is coaxial with the longitudinal axis of the bottle and symmetrical with respect to that axis.

According to a particular embodiment the deformable external side wall of the bottle exhibits the shape of a creased or corrugated wall, four example which is pleated or formed with bellows-like folds.

According to still another characterizing feature of the invention, the device consists of a return-preventing stop means co-operating with a means for guiding the deformation preferably as from the conditioning of the liquid into the bottle, one at least of the said means being retained either by the lower portion or by the upper portion of the bottle or by both of them.

In the meaning of the invention the upper and lower portions of the bottle are spaced by the aforesaid deformable wall and the aperture for the filling and the pouring of the liquid is formed in the upper portion. The lower portion may be formed of the bottom of the bottle and the upper portion may be formed of the neck or even the stopper or plug.

In a first embodiment of the invention the return-preventing stop means comprises a return-preventing interlocking or cogging mechanism and a stop member retained by the upper portion of the bottle through the medium of the guide means and co-operating with the pleated wall of the bottle.

According to one embodiment the pleated configuration of the cylindrical circular wall of the bottle exhibits helical folding lines so as to co-operate with the stop member which is retained in bearing relationship through the agency of a vertical rod forming a guide means in the neck of the bottle, the rotation of the rod in the neck being made unidirectional in the sense of a reduction of volume of the bottle by the return-preventing interlocking mechanism.

One may provide that the stop member co-operates with the inside of a whorl formed by the pleated helical wall of the bottle or that said member bears underneath peripheral ridges which are radially projecting inwards of the bottle from the helical folding lines.

The stop member may be formed of a perforated or fragmentary disk with a diameter substantially equal to the inner diameter of the bottle and parallel to the folding lines of the pleated wall.

The perforated disk may of course be replaced with a plurality of blades radiating from the aforesaid rod.

According to another embodiment, the guide means extends substantially longitudinally in the bottle from its lower portion or from its upper portion and the return-preventing stop means is formed of peripheral ledges perpendicular to the axis of the bottle and projecting inwards of the bottle from the radially inner folding lines of the pleated wall and of at least one catch or projection supported by the guide means and coming in engagement with these ledges.

The guide means may be formed of an externally toothed cylinder coaxial with the bottle, the teeth of the cylinder being adjacent to the pleated wall of the bottle.

Alternatively the guide means may be a longitudinal rod supporting one or several blades the free end of which is toothed and the length of which is equal to the distance separating two opposite side faces of the bottle.

According to still another embodiment of the invention, the guide means is made from at least two parts partially fitted into each other which are retained by the lower portion and the upper portion, respectively, of the bottle and which are more entering each other during a reduction of volume of the bottle, the return-preventing stop means being provided at least in part between the said parts.

One may provide that the return-preventing stop means comprises an anchoring member on the bottom of the bottle and another associated co-operating member intended to be inserted through the neck to become hooked itself onto the said anchoring member.

Preferably the lower and upper portions are rigid enough to avoid their deformation upon the contraction of the bottle.

According to a first embodiment, the guide means is formed of a rod or of a telescopic tube with nestable sections which extend axially in the bottle and the return-preventing stop means consists of catches or teeth formed at least partially on the internal and/or external wall of the nestable sections.

The teeth may of course be substituted for by simple bosses and the catches by grooves, slots or notches.

If the telescopic tube consists of two sections only, one of the sections has teeth on its external face whereas the other section has notches on its internal face or vice versa.

When the telescopic tube comprises at least three nestable sections, the latter are toothed both on its internal and external faces except for the two end sections which are toothed on one face only.

The mutually confronting toothed faces of two nested sections may of course comprise teeth on one of the sections and grooves, slits or notches on the other section.

According to another embodiment, the guide means is formed of a rod and of a hollow cylinder which extend axially in the bottle and the return-preventing stop means comprises an external screw-thread on the aforesaid rod and an internally screw-threaded portion in the vicinity of the free end of the aforesaid tube, the said internally threaded portion being adapted to be screwed onto the screw-threaded rod in the direction of a reduction of volume of the bottle and locked against rotation in the opposite direction for instance by an interlocking mechanism.

When the internally threaded portion forms one single integral part with the tube, the tube being operable for rotation by its top end accessible at the level of the neck and the aforesaid interlocking mechanism is provided between this top end and the internal wall of the neck of the bottle.

One may provide that the pitch of the threading be fine enough to prevent any spontaneous unscrewing.

On the contrary if the internally threaded portion is a separate part forming a nut caged into the free end of the tube, the top end of the latter is held immovable against rotation in the neck and the aforesaid interlocking mechanism is provided between the said nut and the internal wall of the tube.

In this case the volume of the bottle may be reduced by a simple motion of compression in the manner of a child which "resets" the spinning of a toy top.

According to an alternative embodiment the guide means is formed of a rod which is made internally fast preferably axially to the bottle and of a frame which projects in substantially perpendicular relation to the inner wall of the bottle, for instance with several cross arms and bored through its center for the passage of the said rod and the return-preventing stop means comprises serrations or notches or teeth on the aforesaid rod co-operating with a flexible tongue forming a stop dog made fast to the aforesaid frame and projecting radially into the aforesaid bore.

According to still another embodiment of the invention the guide means is formed of a flexible tie which extends axially from the bottom of the bottle and extends into a guide with a zigzag or bent internal passage-way, retained at the upper portion of the bottle and the return-preventing stop means comprises notches in the zigzag passage-way of the guide and co-operating with teeth formed along the flexible tie.

In a general manner one may also provide that the aforesaid co-operating device when it is retained at the level of the neck be not fastened to the latter but urged into simple bearing by the engagement of the guide means and of the return-preventing stop means.

The bearing surface of the device at the level of the neck may either be frusto-conical for resting upon a corresponding surface inside of the neck or constituted by a collar adapted to top the upper end of the opening of the neck or to rest upon a corresponding shoulder formed inside of the neck.

In-a general manner the return-preventing stop means also provides a brake function preventing a spontaneous contraction or collapse of the bottle owing for instance to the slope of the teeth, to the elasticity of the slots, to the interlocking mechanisms or to the friction between the nestable parts.

According to another particular embodiment, the device is formed of a return-preventing stop means co-operating with the pleated inner wall of the bottle which serves as a guide means for the deformation, the said stop means comprising peripheral ridges or ledges which are projecting inwards of the bottle from the innermost folding lines of the pleated wall and of a plurality of hook-like elements projecting from each ridge in the direction of the height of the bottle and adapted to hook themselves onto the immediately adjacent ridge for locking the bottle in the contracted or collapsed position.

One may also provide that the aforesaid hooks be arranged in staggered relationship on the different peripheral ridges or ledges and may exhibit the variable lengths.

The invention will be better understood and further objects, characterizing features, details and advantages thereof will appear more clearly as the following explanatory description proceeds with reference to the accompanying diagrammatic drawings given by way of non-limiting examples only illustrating several presently preferred embodiments of the invention and in which:

BRIEF DESCRIPTION OF THE DRAWING FIGURES

FIG. 1 is a view in elevation and in axial section of a bottle according to a first embodiment of the system of the invention, wherein the device inside of the bottle is telescopic;

FIGS. 2A to 2D are enlarged view of a detail of FIG. 1 shown by the arrows IIA to IID, respectively;

FIG. 3 is a view similar to FIG. 2D but showing an alternative embodiment of the stopper;

FIG. 8 is a view similar to FIG. 6 but showing another embodiment of the system of the invention;

FIG. 9 is an enlarged top view of the bottle of FIG. 8 according to the arrow IX;

FIG. 10 is a view similar to FIG. 8 but showing an alternative embodiment;

FIG. 11 is an enlarged view in section of the internal device of FIG. 10 taken upon the line XI—XI;

FIG. 17 is a view in elevation and in axial section taken upon the line XVII—XVII of FIG. 18 of a bottle according to another embodiment of the system of the invention;

FIG. 18 is a view in cross-section of the bottle of FIG. 17 taken upon the line XVIII—XVIII;

FIG. 19 is a partial view on a larger scale of a detail of FIG. 17 designated by the arrow XIX;

FIG. 20 is a view similar to FIG. 17 but showing the bottle in the contracted or collapsed position;

FIG. 21 is a half view in elevation and in axial section of another embodiment of the system of the invention;

FIG. 22 is a partial view on a larger scale of a detail of FIG. 21 designated by the arrow XXII;

FIG. 23 is a view similar to FIG. 14 but showing the pleated wall in the contracted position; and FIG. 24 is a half view similar to FIG. 21 but showing the bottle in the contracted or collapsed position.

DETAILED DESCRIPTION OF THE PREFERRED EMBODIMENTS

Figure 4:
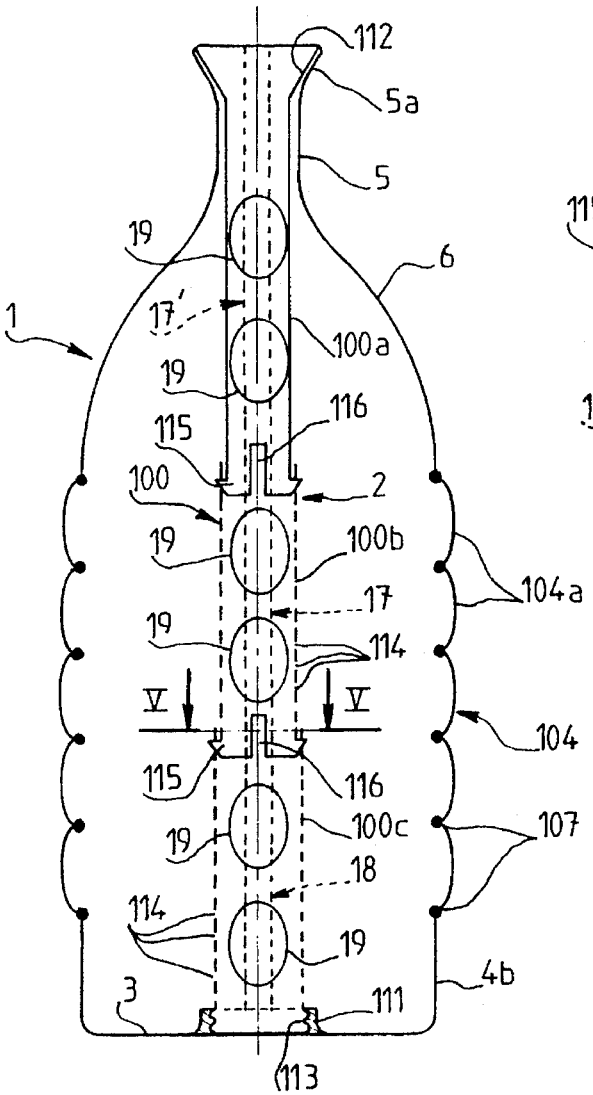
FIG. 4 is a view similar to FIG. 1 but showing an alternative embodiment.

According to the embodiment shown on FIGS. 1 to 3, the system of the invention comprises a bottle 1 and an associated co-operating device 2 integrated into the inside of the bottle and retained within the latter.

The bottle 1 comprises a bottom 3 which is extended by a substantially cylindrical middle portion 4 growing thinner at its upper part towards the neck 5 of the bottle.

The middle portion of the bottle may of course have any shape for example with a substantially elliptical or polygonal cross-section or any other adapted shape.

The upper portion of the bottle 1 is advantageously made thinner at 6 so that at the end of the reduction of the volume of the bottle the room remaining in the bottle be minimum.

At the end of the volume reduction of the bottle indeed the lower end of the thinned portion 6 has come in the vicinity of the bottom 3 of the bottle so that the free space or room remaining in the latter is confined to the inside of the thinned portion 6.

According to the invention, the middle portion 4 of the bottle is deformable in the axial direction of the bottle 1, i.e. in the direction of its height H and exhibits a corrugated or creased for example pleated or bellows-like folded wall.

Peripheral ledges or ridges may be provided at the level of the folding lines 7 of the pleated wall 4 in order to avoid any risk of break or of tear of the bottle at these points.

The pleated wall 4 of FIG. 1 consists of a series of frusto-conical rings 4*a* with a rectilinear section in an axial plane of the bottle, two adjacent frusto-conical rings 4*a* being joined by their respective great base or small base along one folding line 7.

The pleated wall 4 of the bottle 1 here exhibits an alternance of reinforcing circular arches with a small diameter 7*a* and a great diameter 7*b* which are spaced from each other in the direction of the height H of the bottle by their substantially flat portion 4*a*.

During the collapse of the bottle 1, the pleated wall 4 would fold itself in the direction of the axis H of the bottle 1 without generating too substantial a deformation in the substantially flat portions 4*a* which are defined between a reinforcement with a smaller diameter 7*a* and a reinforcement with a greater diameter 7*b*.

The bottle 1 is generally made from stiff plastics material while the middle portion 4 may be made from a semi-rigid material or have a thickness such as to allow the folding of its wall.

The bottom 3 of the bottle is separated from this pleated wall 4 by a lower rigid cylindrical tubular portion 4*b*.

On FIGS. 2D and 3 have been shown two alternative embodiments of a stopper or cap 8 provided with a sealing gasket 9 for closing in a fluid-tight manner the open end of the neck 5 of the bottle 1.

On FIG. 2D, the sealing gasket or washer 9 is provided outside of the threading 8*a* of the stopper or cap 8 whereas on FIG. 3 it is provided inside of the stopper or cap 8 upstream of the threading 8*a*.

The device 2 consists of a telescopic rod 10 having three sections fitting into each other and designated from top to bottom by the reference numerals 10*a*, 10*b* and 10*c*, respectively.

Hooks 11 are projecting inside of the bottle 1 from the bottom 3 to retain the lower end of the telescopic rod 10.

The upper end of the first section 10*a* is bearing through the medium of a collar or flange 12 upon the top edge of the opening of the neck 5 whereas the lower end of the third section 10*b* is caused to be hooked by teeth 13 onto the hooks 11.

It could of course be considered that the telescopic rod 10 be formed of the sections 10*a* and 10*b* only, the section 10*c* forming a toothed rod or rack retained at the level of the bottom 3 of the bottle 1.

It could further be contemplated that the sections 10*a* and 10*b* be formed of at least two vertical toothed fingers extending at right angles to a common base instead of an internally toothed tube.

The intermediate section 10*a* is toothed at 14 over its whole inner wall but at one end 15 only of its outer wall in order to avoid a redundant use thereof with the inner teeth 14 of the first section 10*a*.

In the same manner one end only of the section 10*c* is externally toothed at 15 in order to come in engagement with the teeth 14 of the inner wall of the intermediate section 10*b*.

In the case of course where the reference numeral 10 designates a telescopic rod, apertures are provided on its wall to permit the passage of the liquid into the bottle and outwards thereof.

An elasticity slot 16 is provided at the lower end of the section 10*c* to permit the retraction of the teeth 13 when being hooked onto the hooks 11.

Figure 5:
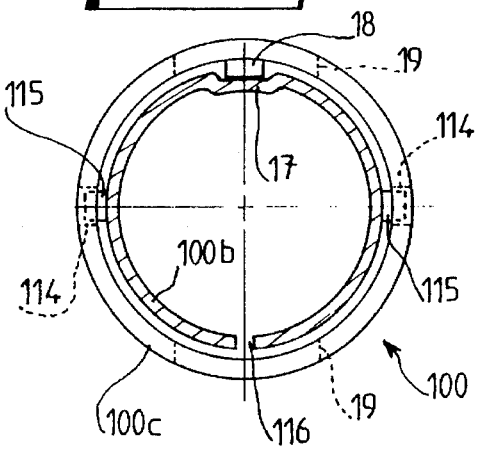
FIG. 5 is an enlarged view in section of the internal device of FIG. 4 taken upon the line V—V.

Referring now to FIGS. 4 and 5, there has been shown an alternative embodiment of the aforesaid telescopic rod.

The telescopic rod 100 here comprises three nestable sections 100*a* to 100*c*.

The upper end of the first section 100*a* comprises a flared-substantially frusto-conical portion 112 which is intended to bear upon a corresponding flared portion 5*a* inside of the neck 5, thereby permitting to directly apply a sealing disk upon the opening of the neck together with an adapted cap.

The lower end of the last section 100*c* is externally threaded at 113 so as to be caused to be screwed into a female internally threaded hollow base 111 to serve as a stop means for the telescopic guide tube 100.

The section with a greater diameter here is in the vicinity of the bottom 3 of the bottle 1 whereas in the alternative embodiment of FIG. 1, the section with a greater diameter is in the vicinity of the upper portion of the bottle.

The sections 100*b* and 100*c* are hollow internally grooved cylinders the inner grooves 114 of which are intended to co-operate with lugs 115 which are radially projecting from the lower end of the external wall of the sections 100*a* and 100*b*.

Elasticity slots 116 are provided in the vicinity of these lugs 115 to permit an easier bending of the latter during their passage from one groove 114 to another subjacent one.

A longitudinal groove 17 is formed along the external wall of the intermediate section 100*b* for receiving a corresponding rib 18 which is radially projecting from the internal wall of the section 100*c* along its height to prevent any rotation of the sections 100*b* and 100*c* with respect to one another.

The section 100*a* also comprises a groove 17' formed along its external wall so as to fit onto a corresponding boss of the groove 17 which projects inwards of the section 100*b* (see FIG. 5).

The lower end 113 may thus be screwed into the base 111 by turning the telescopic tube 100 about itself from the neck 5.

Windows 19 are also provided through the wall of the different sections of the telescopic tube 100 in order to let-pass the liquid contained in the bottle.

The sections of the telescopic tubes 10 and 100 may of course be in any number determined in accordance with the maximum reduction of the bottle which is desired to be obtained.

Figure 7:
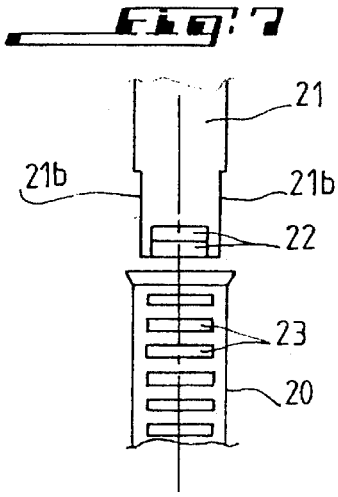
FIG. 7 is an enlarged partial view of the device inside of the bottle of FIG. 6 when looking in the direction of the arrow VII.
Figure 6:
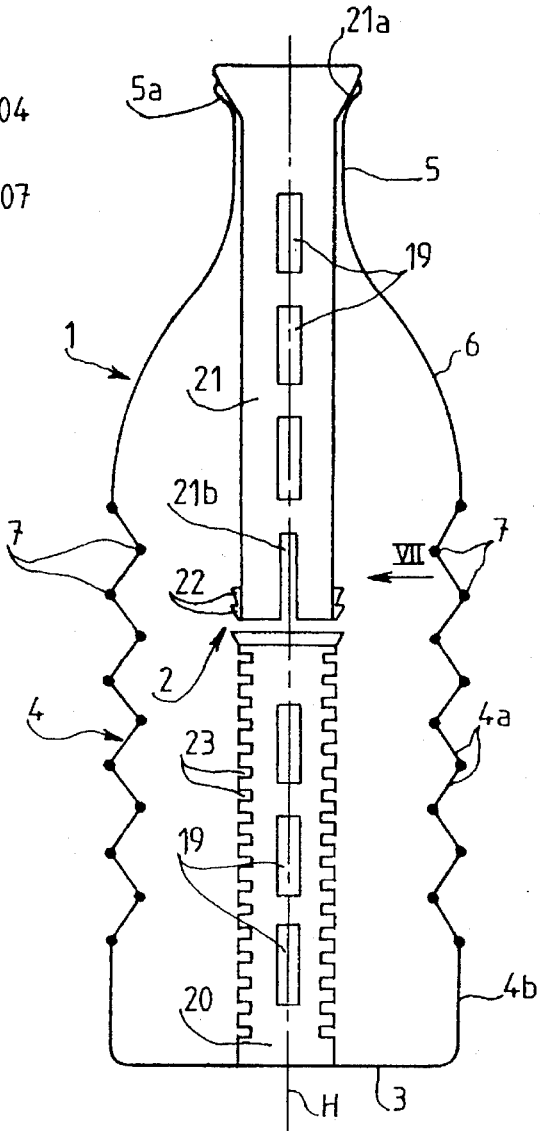
FIG. 6 is a view similar to FIG. 1 but showing still another alternative embodiment.

On FIGS. 6 and 7 has been shown another alternative embodiment of the system of the invention.

The device 2 consists here of a hollow cylinder 20 made fast to one end of the bottom 3 of the bottle 1 and extending axially within the latter and of another hollow cylinder 21 with a diameter smaller than the cylinder 20 and the upper end 21*a* of which is flared in order to bear upon a corresponding flared portion 5*a* inside of the neck 5.

The return-preventing stop means consists here of teeth 22 which are projecting from the external wall of the cylinder 21 in the vicinity of its lower end and of a series of slots 23 formed through the wall of the cylinder 20 over its whole height and in which the teeth 22 are intended to be retained.

Windows 19 are also provided in the cylinders 20 and 21 for the passage of the liquid.

In the alternative embodiments shown on FIGS. 1 to 7, the inner guide means 10, 100 and 20, 21 may of course have any for example elliptical or polygonal section.

In the embodiments shown up to now, the reduction in volume of the bottle 1 is effected in a gradual and stepwise manner in accordance with the number and with the height of the teeth on the internal guide means.

In the alternative embodiment illustrated on FIG. 4, the deformable pleated wall 104 of the bottle 1 is constituted by a series of annular strips 104*a* bulged outwards and joined to each other along peripheral folding lines 107.

The pleated wall 104 comprises a series of reinforcing arches 107 with the same diameter and spaced from each other in the axial direction H by a flexible portion 104*a* which is bulged outwards of the bottle 1.

The bulged portions 104*a* exhibit a substantially thinner wall thickness than that of the reinforcing arches 107.

In both variants of the embodiment shown on FIGS. 8 to 11, the device 2 permits a continuous and or infinitely variable reduction of the volume of the bottle 1.

On FIGS. 8 and 9 the device 2 comprises a guide means formed of a rod 24 axially projecting into the bottle from its bottom 3 and of a cylindrical tube 25 which is retained at its upper end 25*a* in the neck 5 and caused to fit with its lower end 23*b* onto the aforesaid rod 24.

The return-preventing stop means here comprises a stop means formed of an outer threading 24*a* on the rod 24 and a corresponding tapping or internal threading inside of the lower end 25*b* of the tube 25.

It could of course be alternatively provided that the internal surface of the tube 25 be screw-threaded and that the upper end alone of the rod 24 be screw-threaded.

The tube 25 is retained in bearing relationship at the level of its upper end 25*a* upon the internal flared surface 5*a* of the upper end of the neck 5 through the medium of a hand grip-shaped element (see FIG. 9).

The hand grip-like element 25*a* comprises on either side of a central web 26 two apertures 26*a* serving both for the passage of the liquid through the neck 5 and for the gripping of the said element by a user with a view to rotate the tube 25 about the axis H.

The return-preventing stop means moreover comprises a return-preventing means consisting for example of an interlocking mechanism between the hand grip-like element 25*a* and the inner wall of the neck 5, of the type shown on FIG. 11.

FIGS. 10 and 11 show a modification of the device of FIG. 8.

The rod 24 here comprises an external screw-threading 24*a* the pitch of which is definitely greater than that of FIG. 8 so as to permit an easy sliding of a nut 27 on the rod 24.

The nut 27 is caged at the lower end 125*b* of a tube 125 the upper end 125*a* of which is retained in bearing relationship in the neck 5 and locked against rotation for example by a lug 28.

It is seen on FIGS. 10 and 11 that the nut 27 has an axial tapping or internal screw-threading 27*a* with a pitch identical with the external screw-threading 24*a* of the rod 24 as well as inclined teeth 27*b* on its external periphery adapted to co-operate with a pawl-like tongue 29 which is fastened to the internal surface of the lower end 125*b* of the tube 125.

The pawl 29 permits the rotation of the nut 27 in the direction of the arrow F on FIG. 11 but prevents its rotation in the reverse direction.

The mechanism illustrated on FIG. 11 could be adapted to the hand grip-like element 25*a* of the embodiment of FIG. 8 by providing the inclined teeth 27*b* on the periphery of the element 25*a* and the pawl 29 on the internal face of the neck 5 or reversely.

Figure 12:
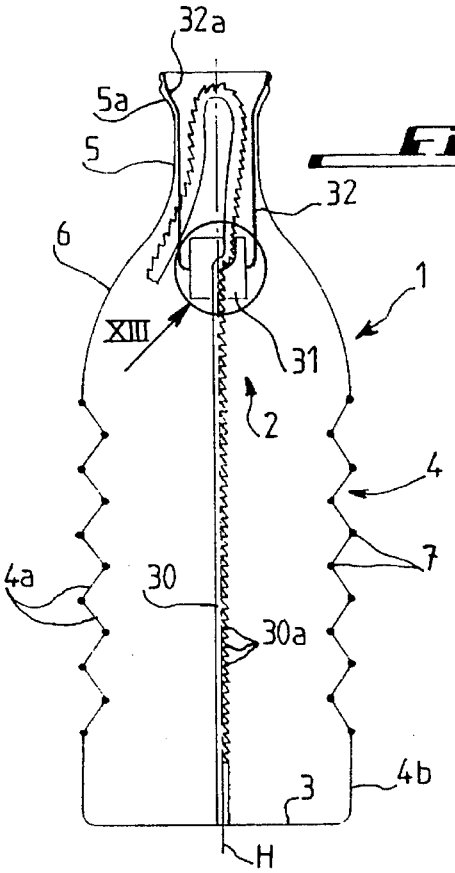
FIG. 12 is a view similar to FIG. 1 but showing still another embodiment of the system of the invention.
Figure 13:
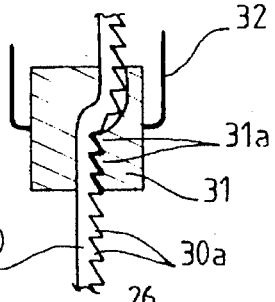
FIG. 13 is an enlarged view in section of a detail of FIG. 12 designated by the arrow XIII.

FIGS. 12 and 13 show still another embodiment of the system of the invention wherein the device 2 comprises a flexible tie 30 which is fastened with one end to the bottom 3 of the bottle 1 and the other end of which is inserted into a guide with an internal zigzag passage-way 31 which is retained by two lugs 32 within the neck 5.

The lugs 32 are bent outwards at their upper end 32*a* in order to be caused to bear upon the upper flared portion 5*a* of the neck 5.

The return-preventing stop means is here formed of teeth 31*a* in the zigzag passage-way of the guide 31 and of inclined teeth 30*a* which are projecting longitudinally from the flexible tie 30 so as to co-operate with the aforesaid teeth 31*a*.

The flexible tie 30 is therefore in a state stretched or tensioned between the bottom 3 of the bottle and the guide 31 and in a released state at the outlet of the guide 31 at the level of the neck 5.

One could also provide although this has not been shown a yielding tie without teeth fastened onto the bottom of the bottle with one end and the other end of which is retained at the level of the neck by an adapted means by making a knot with the tie or by clamping dogs.

Figure 14:
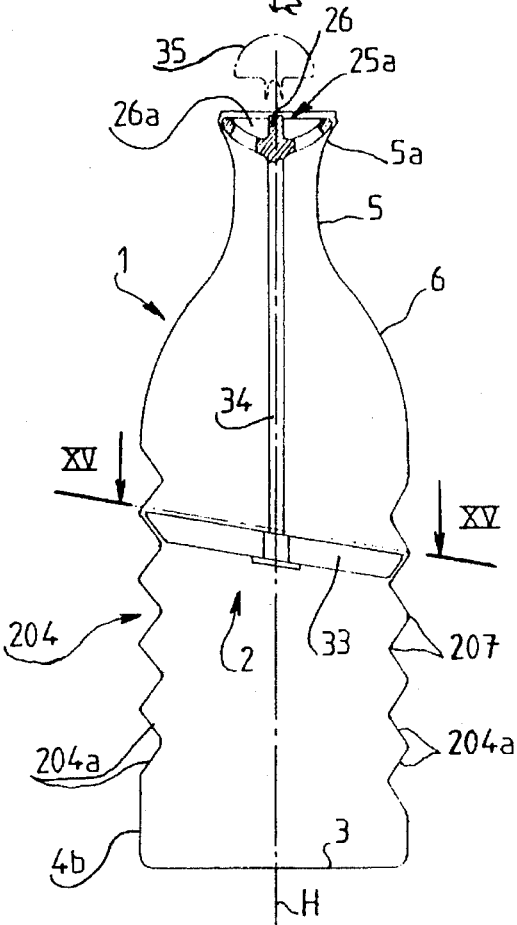
FIG. 14 is a view similar to FIG. 1 but showing a fourth embodiment of the system of the invention wherein the pleated wall of the bottle serves as a guide means for the device inside of the bottle.
Figure 15:
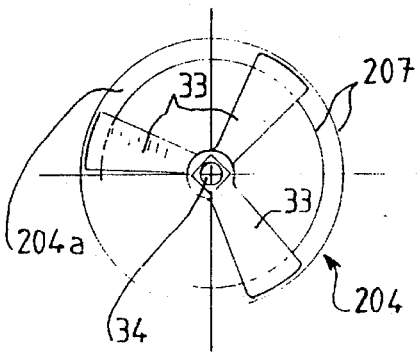
FIG. 15 is a view in section taken upon the line XV—XV of FIG. 14.

On FIGS. 14 and 15 has been shown another embodiment of the system of the invention wherein the pleated wall 204 of the bottle 1 is cylindrical and exhibits helical folding lines 207 so that the inner surface of the frusto-conical rings 204*a* serve as a ramp for a stopping member 33.

The stop member 33 is retained by a vertical rod 34 which is bearing in the neck 5 through the agency of the aforesaid hand grip-like element 25*a*.

On FIG. 14 has been shown in chain-dotted lines a gripping member 35 which may be used to rotate the hand grip-like element 25 about the axis H of the bottle.

As in the embodiment of FIG. 8 an interlocking mechanism is provided between the hand grip-like element 25*a* and the neck 5 of the bottle although not shown on FIGS. 8 and 14.

The stopping member 33 consists here (see FIG. 15) of several blades radiating from the vertical rod 34 and the free end of which is caused to be inserted into one whorl of the helically pleated wall 204.

The blades 33 could of course be replaced with a perforated disk.

On FIG. 14 it is seen that the stopping member 33 is substantially parallel to a folding line 207 of a whorl of the pleated wall 204.

The blades 33 are of course made fast to for rotation with the vertical rod 34.

Figure 16:
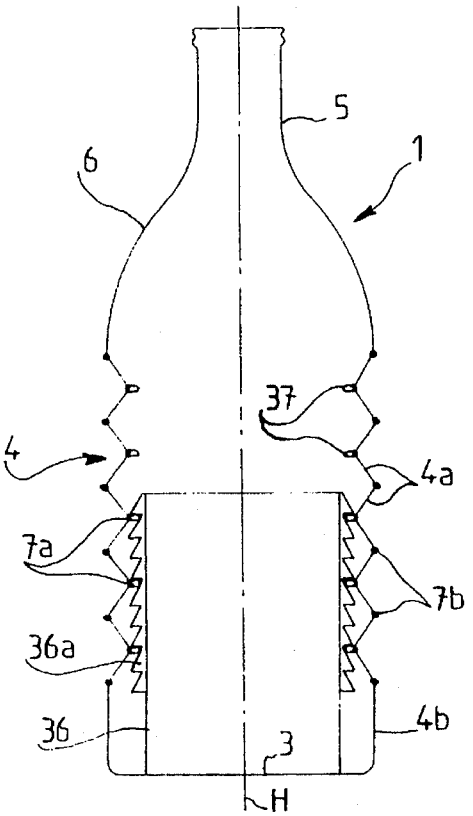
FIG. 16 is a view similar to FIG. 14 but showing still another embodiment of the system of the invention.

FIG. 16 shows a fifth embodiment of the system of the invention in which the guide means is formed of a cylinder 36 concentric with the bottle, fastened onto the bottom 3 of the latter and adjacent to the internal pleated wall 4.

The cylinder 36 could of course be alternatively provided at the level of the upper portion of the bottle 1 in the manner of an inner skirt.

The return-preventing stop means is formed here of peripheral edge flanges 37 which are radially projecting inwards of the bottle from the innermost folding lines 7*a* of the pleated wall 4 and of teeth 36*a* inclined towards the bottom 3 and which are projecting from the external side surface of the cylinder 36.

The folding lines 7 of course are here perpendicular to the axis H of the bottle 1.

In the form of embodiment of the pleated wall 4 shown on FIG. 16, the peripheral edge flanges 37 are provided at the level of every second folding line since the innermost folding lines 7*a* only may come in engagement with the teeth 36*a*.

On the contrary if the pleated wall 104 of FIG. 4 is used, the peripheral edge flanges may be provided at the level of all the folding lines 107.

One will now briefly describe the mounting and the operation of the system of the invention with reference to FIGS. 1 to 3.

One has at first provided through injection into a same mold a preform which is subsequently blown up or inflated to form the bottle 1 which is provided with the hooks 11 on its bottom 3.

One then slips through the neck 5 the telescopic rod 10 the sections of which have already been partially nested and one engages the teeth 13 of the last section 10*c* with the hooks 11.

The device 2 is then inside of the bottle 1 and retained therein at its lower end by the hooks 11 and at its upper end by the collar or flange 12 which is bearing at the level of the top end of the neck 5.

The next step consists in filling the bottle 1 with the desired liquid up to the vicinity of the upper end of the neck 5 so as to reduce in a maximum fashion the volume of the air topping the liquid contained in the bottle.

The opening of the neck 5 is then closed in a fluid-tight manner by the stopper or cap 8 and the bottle is ready for use.

One thus avoids during the storage of the bottle after its conditioning an undesirable elongation of the bottle in the direction of the height H since the device 2 prevents any moving away of the bottom 3 of the bottle with respect to its upper portion 5, 6.

On FIGS. 6 and 10 it is therefore necessary to engage both parts of the device 2 with each other before filling the bottle 1 in order to produce the result stated hereinabove.

One may alternatively provide that a threaded base 111 (FIG. 4), a tube 20 (FIG. 6), a threaded rod 24 (FIGS. 8 and 10) or a toothed cylinder 36 (FIG. 16) be made integral in one single piece through molding with the bottle 1.

When a user opens the bottle 1 for the first time by unscrewing the cap 8 and pours one part of the contained liquid outside of the bottle, the user before closing the bottle again would compress it by pressing for instance upon its top so as to deform the pleated wall 4 and to fold or collapse it until the level of the liquid remaining in the bottle reaches the upper portion of the neck 5.

At the same time as the folding of the pleated wall 4, the nestable sections 10*a* to 10*c* of the telescopic rod 10 would retract into each other and retain the bottle 1 in the new state of reduced volume owing to the co-operation of the teeth 14 and 15.

Once the user has caused the inner volume of the bottle to be in conformity with the volume of the liquid remaining in the latter, he would put the cap 8 back on its place on the opening of the neck 5.

Moreover as the successive consumptions of the liquid contained in the bottle 1 proceed, the sections of the telescopic rod 10 are fitting more and more into each other thereby contributing to strengthen the axial guiding of the contraction through the formation of a multiple wall, in the present case a double or treble wall.

The other embodiments shown operate in a manner similar to that of the system of FIG. 1 except for the embodiments of FIGS. 8, 12 and 14.

In the embodiments of FIGS. 8 and 14, the contraction or collapse of the bottle is produced by causing the hand grip 25*a* to be turned about its axis inside of the neck either directly by hand by the user or indirectly through the medium of the member 35.

One may also exert a compression upon the bottle 1 in the direction of the arrow IX of FIG. 8 in order to facilitate the rotation of the hand grip 25*a*.

In the embodiment of FIG. 12, it is necessary to pull on the flexible toothed tie 30 at the same time as or subsequently to the compression of the bottle 1.

After the full consumption of the liquid contained in the bottle, one may give the latter its initial shape again with a view for example to reuse it or to recover some parts thereof.

In the embodiment of FIG. 1 owing to the elasticity slit 16, it suffices to disengage or unhook the teeth 13 from the hooks 11 with the assistance of an adapted tool inserted from the neck 5 so as to withdraw the telescopic tube 10.

In the embodiment of FIG. 4, it suffices to rotate the telescopic tube 100 about its axis for unscrewing the lower end 13 of this tube.

In the embodiment of FIG. 6, it is possible to disengage the tube 21 from the tube 20 by inserting from the neck 5 an adapted tool for retracting the teeth 22 owing to the elasticity slit 21*b*.

In the embodiment of FIG. 16 if the elasticity slits are provided in the cylinder 3, it suffices to insert an adapted tool through the neck 5 for drawing the teeth 36*a* back into a retracted position and to thus allow the bottle 1 to return into its initial position.

It may also be desirable to come back to a state of greater volume of the bottle with a view to pour some amount of liquid into the latter from another bottle for example already opened and partially used up.

On FIG. 1 one may provide for example that the teeth 4 be present on one sector only of the section 10*a* so that by turning the latter with respect to the section lob one may disengage the teeth 14 from the teeth 15 and thus permit the return to a state of larger volume of the bottle without withdrawing the telescopic tube 10.

On FIG. 8 one may selectively come back to a state of greater volume by first compressing the bottle with a view to reducing its volume for unlocking the interlocking relationship between the hand grip 25*a* and the neck 5 and then by unscrewing the tube 25 from the threaded rod 24 until reaching the state of desired volume and at last by releasing the pressure upon the bottle for engaging the interlocking again.

The system of the invention may of course be applied to bottles intended to contain non fizzy drinks and even pasty fluids in order to avoid to a maximum the contact of the contained fluid with the air topping the latter within the bottle.

In the meaning of the invention the bottle designates any type of container either or not provided with its closure cap.

The device of the system of the invention may be incorporated partially into the closure cap or into the wall of the bottle without departing from the scope of the invention.

One may thus provide a yielding or rigid toothed rod fastened with one end onto the bottom of the bottle and the other end of which extends through the cap in which is provided an adapted interlocking or stopping mechanism.

It should also be pointed out that the teeth on FIGS. 1 to 7 ensure the function of a brake preventing the spontaneous contraction or collapse of the bottle.

In the alternative embodiment shown on FIGS. 17 to 20, the associated co-operating device 2 comprises a toothed rod 310 forming a rack which projects inside of the bottle 1 from the bottom 3 thereof and extends for instance up to above the deformable middle portion 4.

The device 2 further comprises a guide member such as a cross frame 311 which is formed inside of the bottle 1 in a plane perpendicular to the axis H and which is made fast to the inner side wall of the bottle.

One may of course vary in any manner whatsoever the number of arms or legs of the guide member 311 or even adopt any other shape.

The cross-frame 311 is bored through in its center to form an aperture 312 for the passage of the upper end of the toothed rod 310.

A flexible tongue 313 projects radially into the aperture 312 to co-operate with the teeth 314 and the associated teeth 315 of the toothed rod 310.

On FIG. 17 it is seen that the teeth 314 are directed towards the bottom 3 of the container 1 to allow the flexible tongue 313 to slide while curving itself on the inclined portion of the teeth 314 when the bottle 1 is squeezed in the direction of the axis H.

One could alternatively provide several tongues 313 as well as a rod toothed over its whole periphery.

The toothed rod 313 comprises a stop collar or flange 316 below the toothed portion of the rod 310 in order to come in abutment against the aforesaid guide member 311 so as to limit the contraction or collapse of the bottle and to thus avoid that the toothed rod 310 extends beyond and juts out of the neck 5 thereby preventing the closing of the bottle 1 or that the pleated wall 4 becomes cracked following too great a deformation.

On FIG. 20 has been shown the bottle 1 in the contracted position in which one has decreased the height of the bottle 1 by several teeth 315.

The tongue 313 serves as a stop means in the contracted position since it comes in abutment against the face of one tooth 315 which is opposite to its face inclined towards the bottom 3 of the bottle.

The toothed rod 310 thus permits to decrease the height and the volume of the bottle 1 stepwise in accordance with the number and with the height of the teeth on this rod.

During the squeezing of the bottle 1, the bulged walls 104*a* would be curved outwards of the bottle and the reinforcing circular arches 107 would move towards each other in the axial direction H.

The circular reinforcements 107 have the function both to avoid any risk of break of the pleated wall 4 at the level of the folding lines and to withstand the circumferential force generated by the liquid enclosed in the bottle 1.

Indeed when the bottle 1 contains a fizzy liquid, the inner pressure of the bottle 1 when the latter is closed may reach 6 bars for example. One could of course alternatively provide that the toothed rod be fastened inside of the upper portion of the bottle 1, its free end being directed towards the bottom 3 of the bottle and the guide member 311 being located underneath that reinforcing arch 107 which is nearest to the bottom of the bottle without for all that changing the principle of operation of the system of the invention.

On FIGS. 21 to 24 is shown still another embodiment of the system of the invention in which the associated co-operating device 2 comprises edge flanges 334 engageable with hooks 335.

The pleated wall 104 of this embodiment is substantially identical with that of the bottle shown on FIG. 4 except that the circular reinforcements 107 are extended by peripheral edge flanges 334 projecting radially inwards of the bottle 1 in the manner of the edge flanges 37 of FIG. 16.

Hooked-like elements 335 are projecting from each peripheral edge flange 334 in the direction of the height of the container and their bent end 335*a* faces the internal wall of the container 1 so that this bent end 335*a* is caused to be hooked onto an immediately adjacent edge flange during the squeezing or collapsing of the bottle 1 in the axial direction H.

The hooks 335 may be arranged in staggered relationship on different peripheral edge flanges 334 and may exhibit a variable length so as to carry out a gradual contraction of the bottle 1 during its collapse.

The system of the invention thus permits to adapt the volume of the bottle to the volume of the liquid remaining in the latter after its use.

The upper portion 6 of the bottle 1 is preferably made to be flared so that a smaller volume of liquid be contained in the upper portion.

Thus in the maximum contracted position of the bottle 1 there would only remain a very small volume of liquid in the bottle 1 which may be consumed by the user during one single subsequent utilization.

One may of course provide that the bottle 1 and its different locking means be made integral in one piece of material and made from one and the same plastics material.

The system of the invention may be provided by the injection in a same mold of a preform which is subsequently blown up or inflated to form the bottle fitted with its associated co-operating device.

In the case of the embodiment of the system of the invention shown on FIGS. 17 to 20, one may make the bottle 1 into two parts, namely an upper and a lower part to permit for example in an easy manner the mounting of the cross-frame 311 inside of the bottle 1.

Although the invention has been described in connection with several particular embodiments, it is obvious that it should not be limited thereto and that it comprises all the technical equivalents of the means described and their combinations if the latter fall within the scope of the appended claims.

What is claimed is:

1. A system consisting of a collapsible bottle with a variable volume intended to contain a liquid, and comprising a axially deformable outer side wall and of an associated cooperating device integrated into the inside of the bottle and retained therein, said device having means for gradually adjusting the inner volume of the bottle to the volume of the liquid remaining in the bottle after each subsequent use and for holding the bottle in one of a series of collapsed states of reduced volume corresponding to the volume of remaining liquid.

2. A system according to claim 1, wherein the deformable external side wall of the bottle is in the shape of a pleated wall.

3. A system according to claim 1, wherein the device is formed of a return-preventing stop means cooperating with a means for guiding the deformation, at least one of the said means being retained by the lower portion and the other by the upper portion of the bottle.

4. A system according to claim 3, wherein the guide means is made in at least two parts partially fitted into each other, one of which is retained by the lower portion and the other of which by the upper portion of the bottle, and which are further entering into one another during a reduction of volume of the bottle, the return-preventing stop means being provided at least partially between the said parts.

5. A system according to claim 4, wherein the guide means is formed of a telescopic tube with nestable sections which extend axially in the bottle and the return-preventing stop means comprises teeth formed at least partially on the wall of the nestable sections.

6. A system according to claim 4, wherein the guide means is formed of a rod and of a hollow cylinder which extend axially in the bottle and the return-preventing stop means comprises external threads on said rod and internal threads on the free end of said tube, said internal threads being adapted to be screwed onto the rod threads in the direction of reduction of volume of the bottle.

7. A system according to claim 6, wherein the internal threads are integral with the tube, the tube being operable for rotation by its upper end accessible at the level of the neck and an interlocking mechanism is provided between the internal wall of the neck of the bottle and the said upper end for locking the latter against rotation in the direction opposite to the reduction of volume.

8. A system according to claim 6, wherein the internal threads of the tube is a separate part forming a nut caged into the free end of the tube, the upper end of the tube being held immovable against rotation within the neck and the interlocking mechanism being provided between the nut and the inner wall of the tube.

9. A system according to claim 4, wherein the guide means is formed of a flexible tie which extends axially from the bottom of the bottle and extends into a guide with an internal bent passage-way, retained at the upper portion of the bottle and the return-preventing stop means comprises teeth in the bent passage-way of the guide and cooperating with teeth formed along the flexible tie.

10. A system according to claim 4, wherein the guide means is formed of a rod which is made fast inside of and to the bottle and of a frame which projects in substantially perpendicular relation to the inner wall of the bottle and bored through in its center for the passage of the said rod and wherein the return-preventing stop means comprises protrusions on the aforesaid rod cooperating with a flexible tongue forming a stop made fast to the frame and projecting radially into the bore.

11. A system according to claim 1, wherein the device is formed of return-preventing stop means cooperating with a means for guiding the deformation, at least one of the said means being retained by the upper portion of the bottle.

12. A system according to claim 2, wherein the pleated configuration of the circular cylindrical wall of the bottle exhibits helical folding lines so as to cooperate with a stop member which is retained in bearing relationship through the medium of a vertical rod forming a guide means in the neck of the bottle, the rotation of the rod within the neck being made unidirectional in the direction of a reduction of volume of the bottle by return-preventing interlocking means.

13. A system according to claim 12, wherein the stop member cooperates with the inside of a whorl formed by the internal wall of the bottle.

14. A system according to claim 1, wherein the device is formed of return-preventing stop means cooperating with means for guiding the deformation, at least one of the said means being retained by the lower portion of the bottle.

15. A system according to claim 2, wherein the guide means extends substantially longitudinally in the bottle and the return-preventing stop means is formed of peripheral edge flanges perpendicular to the axis of the bottle and projecting inward of the bottle from the radially inner folding lines of the pleated wall, and of at least one projection supported by the guide means and engageable with the edge flanges.

16. A system according to claim 3, wherein the return-preventing stop means comprises an anchoring member on the bottom of the bottle and another associated cooperating member intended to be inserted through the neck for hooking engagement with the anchoring member.

17. A system according to claim 3, wherein the device when it is retained at the level of the neck of the bottle is urged towards a simple bearing relationship with the latter by the engagement of the guide means and of the return-preventing stop means.

18. A system according to claim 17, wherein the bearing surface of the device at the level of the neck is caused to rest upon a corresponding surface inside of the neck.

19. A system according to claim 2, wherein the device is formed of return-preventing stop means cooperating with the internal pleated wall of the bottle which serves as a means for guiding the deformation, the stop means comprising peripheral edge flanges which project inwardly of the bottle from the innermost folding lines of the pleated wall, and of a plurality of hook-like elements projecting from each edge flange in the direction of the height of the bottle and adapted to be hooked onto the immediately adjacent edge flange for locking the bottle in the contracted position.

20. A system according to claim 19, wherein the hooks are arranged in staggered relationship on the different peripheral edge flanges.

21. A system according to claim 3, wherein the return-preventing stop means also ensures a brake function preventing a spontaneous contraction or collapse of the bottle.

22. A system according to claim 3, in which the deformation occurs in the longitudinal direction of the bottle and wherein the device is coaxial with the longitudinal axis of the bottle and symmetrical with respect to that axis.

23. A system according to claim 12, wherein the stop member is bearing underneath peripheral edge flanges which are radially projecting inwards of the bottle from the helical folding lines.

* * * * *